US005388711A

United States Patent [19]

Hodges

[11] Patent Number: 5,388,711

[45] Date of Patent: Feb. 14, 1995

[54] RAIL CAR DOUBLE ACTING PISTON SHOCK ABSORBER

[75] Inventor: Richard N. Hodges, Arlington, Tex.

[73] Assignee: F M Industries, Inc., Fort Worth, Tex.

[21] Appl. No.: 119,964

[22] Filed: Sep. 10, 1993

[51] Int. Cl.[6] ..... B61G 9/16

[52] U.S. Cl. ..... 213/8; 213/43; 213/45; 213/46 R; 188/287

[58] Field of Search ..... 213/7, 8, 10, 43, 44, 213/45, 46 R, 50; 188/287, 312, 315, 322.22

[56] References Cited

U.S. PATENT DOCUMENTS

| | | | |
|---|---|---|---|
| 1,151,068 | 8/1915 | Van Auken | 188/312 X |
| 2,915,198 | 12/1959 | Spencer | 213/43 |
| 3,186,562 | 6/1965 | Angold . | |
| 3,361,269 | 1/1968 | Peterson | 213/43 X |
| 3,369,674 | 2/1968 | Carle | 213/8 X |
| 3,731,914 | 5/1973 | Cope et al. | 213/43 X |
| 3,749,255 | 7/1973 | Cope | 213/45 X |
| 3,776,391 | 12/1973 | Hawthorne . | |
| 3,854,596 | 12/1974 | Stephenson et al. . | |
| 4,026,418 | 5/1977 | Hawthorne . | |
| 4,304,338 | 12/1981 | Carle et al. . | |
| 4,591,031 | 5/1986 | First | 188/312 X |

OTHER PUBLICATIONS

Keystone Shock Control Hydraulic Cushioned Underframe (Protects Cars and Lading–Reduces LOSS and DAMAGE Claims), Sec. 12, Keystone Railway Equipment Co., Chicago, Ill. 60604.

*Primary Examiner*—Robert J. Oberleitner
*Assistant Examiner*—S. Joseph Morano
*Attorney, Agent, or Firm*—James E. Bradley

[57] ABSTRACT

A shock absorber for use with a sliding center sill rail car utilizes an internal gas type spring. The shock absorber has a housing and a cylinder located in the housing that moves with the center sill. An annular outer chamber surrounds the cylinder within the housing. Two pistons are slidably carried in the cylinder for independent movement relative to each other. Each has a shaft that extends in opposite directions. The shafts engage stationary stops mounted stationarily to the frame of the rail car. Ports are located in the side wall of the cylinder for the outflow and inflow of a gas and liquid fluid combination. The ports are symmetrical measured either from the rearward end or the forward end.

12 Claims, 5 Drawing Sheets

RAIL CAR DOUBLE ACTING PISTON SHOCK ABSORBER

BACKGROUND OF THE INVENTION

1. Field of the Invention

This invention relates in general to shock absorbers for railway cars, and in particular to an underframe, sliding sill shock absorber.

2. Description of the Prior Art

Rail cars commonly use shock absorbers to avoid excessive shock through the rail car structure and to the lading contained therein. In one type, the shock absorber is located at one end of a rail car and integrated with the coupling structure. In another type, the frame will slide relative to the center sill of the rail car. The center sill is fixed in length, and has ends that protrude from the opposite ends of the frame for connecting to coupling equipment.

A shock absorber is located underneath the frame between two stationary stops which are mounted to the frame. The shock absorber includes a housing that is stationarily secured to the center sill. The housing contains an inner cylinder which has ports in its sidewall and is of smaller diameter than the housing to provide an outer reservoir or outer chamber surrounding the inner cylinder. In the prior art, a single piston slides within the inner cylinder. A single piston shaft extends in both directions from the piston. The ends of the shaft will be spaced closely to the stationary stops.

In one prior art type, a liquid only locates in the inner cylinder and housing. The housing is stationary with the center sill, while the piston shaft moves with the frame. If a shock occurs, the frame and center sill will slide relative to one another, causing the piston to move relative to the cylinder. The restrictive flow of fluid out the ports in the inner cylinder dampens the shock. A large coil spring urges the housing and cylinder to a central position relative to the piston. While workable, the large coil spring is heavy, expensive, and fatigues. In another prior art type, a gas is used rather than a coil spring. That type uses a single piston and shaft. However, because of its shorter length, extensive modification to the rail car is required in order to replace the liquid only type.

SUMMARY OF THE INVENTION

In this invention, the shock absorber housing and cylinder also stationarily mount to the center sill for movement with the center sill. However, two independently acting pistons are utilized. The rearward piston has a piston shaft that extends back and will engage the rearward stationary stop. The forward piston has a separate piston shaft that extends forward to engage the forward stationary stop. The stationary stops are mounted to the rail car frame. A combination of gas and liquid is contained in the inner and outer chambers within the shock absorber. The pressure from the gas urges the pistons to the extended positions.

The ports in the cylinder are arranged so that they are symmetrical from each end of the cylinder. The total outflow orifice area in front of the rearward piston will decrease at a selected rate as the rearward piston moves forward relative to the cylinder. Similarly, the total outflow orifice flow area rearward of the forward piston decreases at the same rate while the forward piston moves rearward relative to the cylinder.

Also, preferably, some of the ports within a zone near the rearward piston will have delaying pressure relief valves. Some of the ports in a zone near the forward piston will also have delaying or pressure relief valves. When the rearward piston begins to move forward relative to the cylinder due to a shock, the valves in the rearward zone will not open, however the valves in the forward zone will open. The converse is true when the forward piston begins to move rearward relative to the cylinder due to a shock.

DETAILED DESCRIPTION OF THE INVENTION

Figure 1:
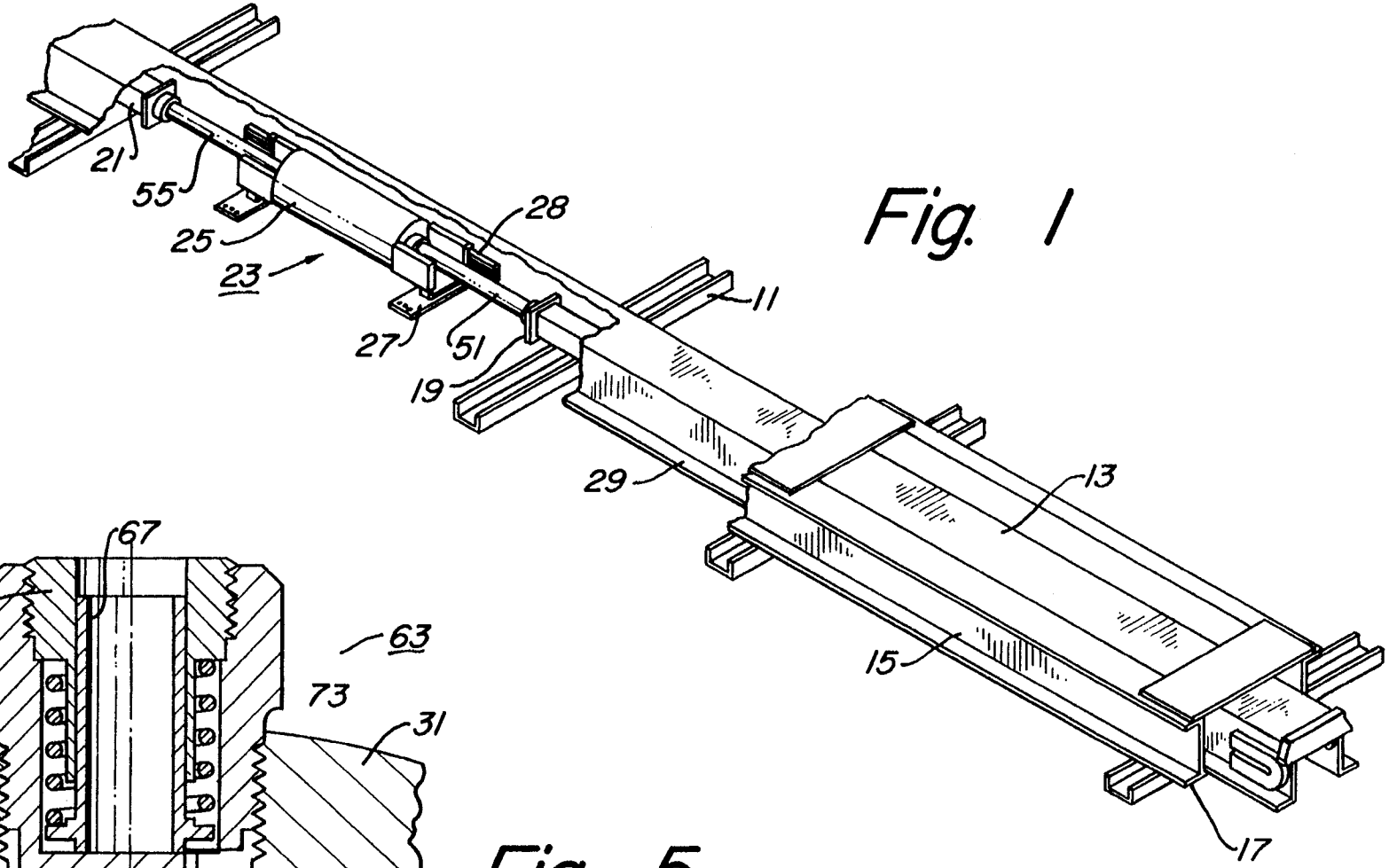
FIG. 1 is a partial isometric view illustrating an underframe of a rail car which has a sliding sill and a shock absorber constructed in accordance with this invention.

Referring to FIG. 1, numeral 11 illustrates portions of the underframe of a rail car. A center sill 13 extends longitudinally under the rail car along frame 11. Center sill 13 extends slidingly through a box 15, which is stationarily mounted to and forms a part of frame 11. Center sill 13 is fixed in length, is slightly longer than frame 11, and has ends 17 which will secure to coupling equipment for coupling to adjacent rail cars. Center sill 13 is a channel shaped member with the open portion of the channel facing downward. The frame 11 and the rest of the rail car can slide approximately twenty inches relative to center sill 13 between center sill stops.

A shock absorber forward stop 19 is stationarily mounted to frame 11. A shock absorber rearward stop 21 is stationarily mounted to frame 11 and spaced longitudinally from forward stop 19. Stops 19, 21 are located within center sill 13 and are mounted to some of the transverse members of frame 11.

Figure 2A:
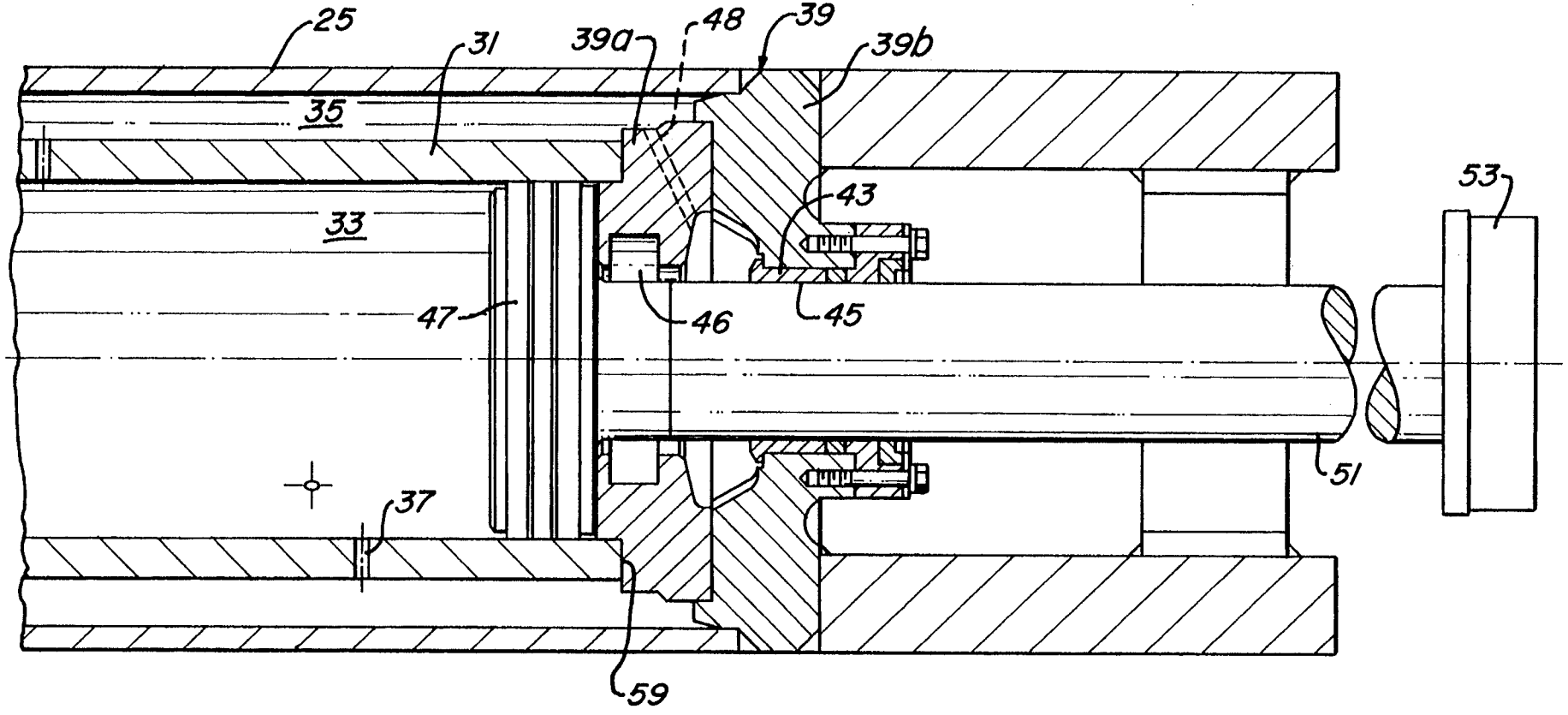
FIGS. 2A and B comprise a sectional view of the shock absorber of FIG. 1.
Figure 2B:
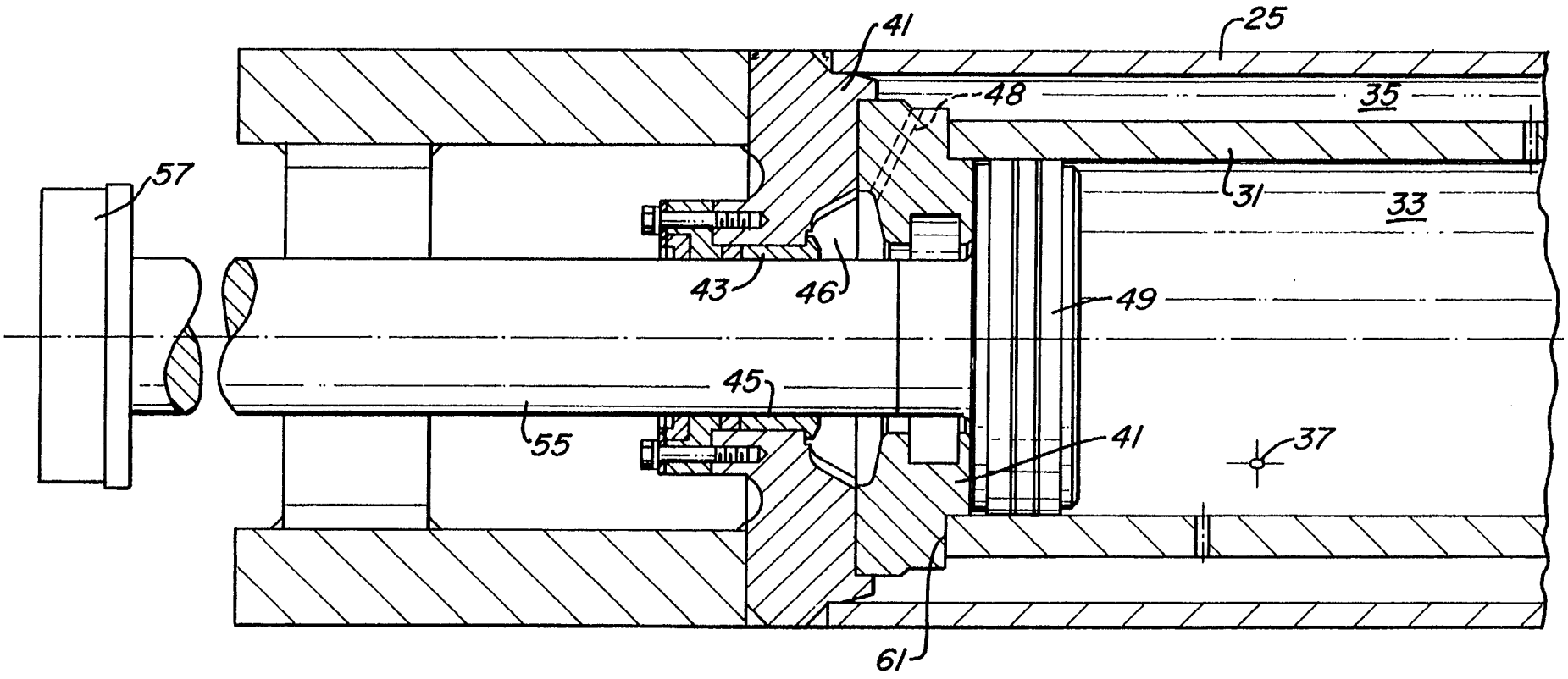

A shock absorber 23 locates between the stops 19, 21. Shock absorber 23 has a housing 25 that is stationarily mounted to center sill 13. The mounting means includes brackets 27 which bolt to flanges 29 on center sill 13. Gussets 28 are welded to an interior side of the center sill 13 forward and rearward of housing 25 as bracing against movement of housing 25 relative to center sill 13. Referring to FIGS. 2A and 2B, an inner cylinder 31 having an inner chamber 33 is mounted stationarily in housing 25. Housing 25 is cylindrical, and inner cylinder 31 is cylindrical, but of a lesser diameter than the inner diameter of housing 25. An annular outer chamber 35 or reservoir surrounds cylinder 31 within housing 25. A number of ports 37 (only a few shown in FIGS. 2A and 2B) are located in the sidewall of cylinder 31. Ports 37 allow the outflow from inner chamber 33 to outer chamber 35 and also the reverse.

A forward bulkhead 39 locates on the forward end of cylinder 31. Forward bulkhead 39 is made of two plates, including an inner plate 39a and an outer plate 39b, closing forward ends on both the inner chamber 33 and the outer chamber 35. A similar two-plate rearward bulkhead 41 (FIG. 2B) locates at the rearward end of cylinder 31. Each of the bulkheads 39, 41 has a bushing 43 that is coaxial with the axis of cylinder 31. A bore 45 locates in each bushing 43. Each bulkhead 39, 41 has a bulkhead recess 46 of larger diameter than bore 45. Bulkhead recess 46 communicates with outer chamber 35 by way of passages 48, shown by dotted lines.

A forward piston 47 slidingly and sealingly locates in cylinder 31 and is in contact with the forward bulkhead 39 when in the extended position shown in FIG. 2A. Similarly, a rearward piston 49 slidingly and sealingly locates in cylinder 31 and is in contact with the rearward bulkhead 41 when in the extended position shown in FIG. 2B. Pistons 47, 49 are not connected to each other, and are independently movable relative to each other.

A forward shaft 51 extends forward from forward piston 47 through bore 45 of bushing 43. Forward shaft 51 terminates in a stop end 53. Stop end 53 is adapted to engage forward stop 19 (FIG. 1) when frame 11 moves rearward relative to center sill 13 due to a shock, or stated another way, when forward piston 47 moves rearward relative to cylinder 31. A rearward shaft 55 extends rearward from rearward piston 49, as shown in FIG. 2B. Rearward shaft 55 extends through bore 45 of bushing 43. The terminal end of rearward shaft 55 is a stop end 57, which is adapted to engage rearward stationary stop 21 (FIG. 1). When stop end 57 contacts stationary stop 21, rearward piston 49 will move forward with frame 11 (FIG. 1) relative to cylinder 31 and center sill 13.

Inner chamber 33 and outer chamber 35 contain a mixture or combination of liquid and gas. The pressure of the gas under no load or static condition will tend to equalize in the inner chamber 33 and the outer chamber 35. The gas pressure acts on the shafts 51, 55 of pistons 47, 49, pushing them apart from each other to the extended positions. The pressure area acted on by the gas pressure is the area of the bushing bores 45. The static gas pressure is substantially the same on both sides of each piston 47, 49, because the static pressure in the bulkhead recesses 46 is the same as in the outer chamber 35. It is not necessary for the pistons 47, 49 to form gas tight seals. In the extended positions, pistons 47, 49 will be contacting bulkheads 39, 41 respectively. In this extended position, the stop ends 53, 57 will be substantially touching the stationary stops 19, 21. A slight clearance, of ⅛th inch or so, will exist between the stop ends 53, 57 and the stationary stop 19, 21 for the purpose of ease in installation of the shock absorber assembly 23.

Figure 3:
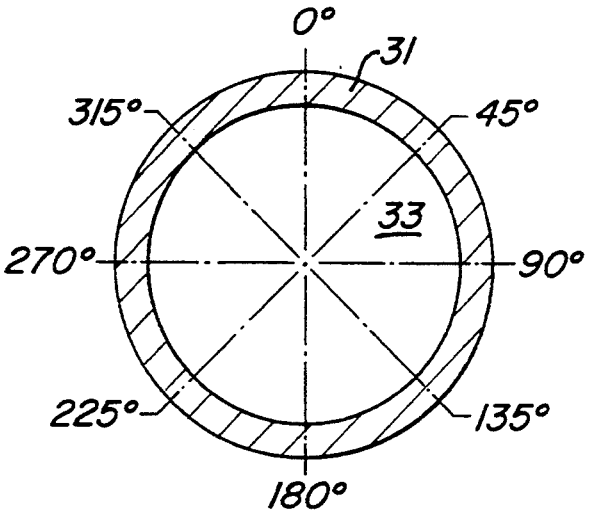
FIG. 3 is a transverse sectional view of the cylinder of the shock absorber of FIGS. 2A and 2B.
Figure 4:
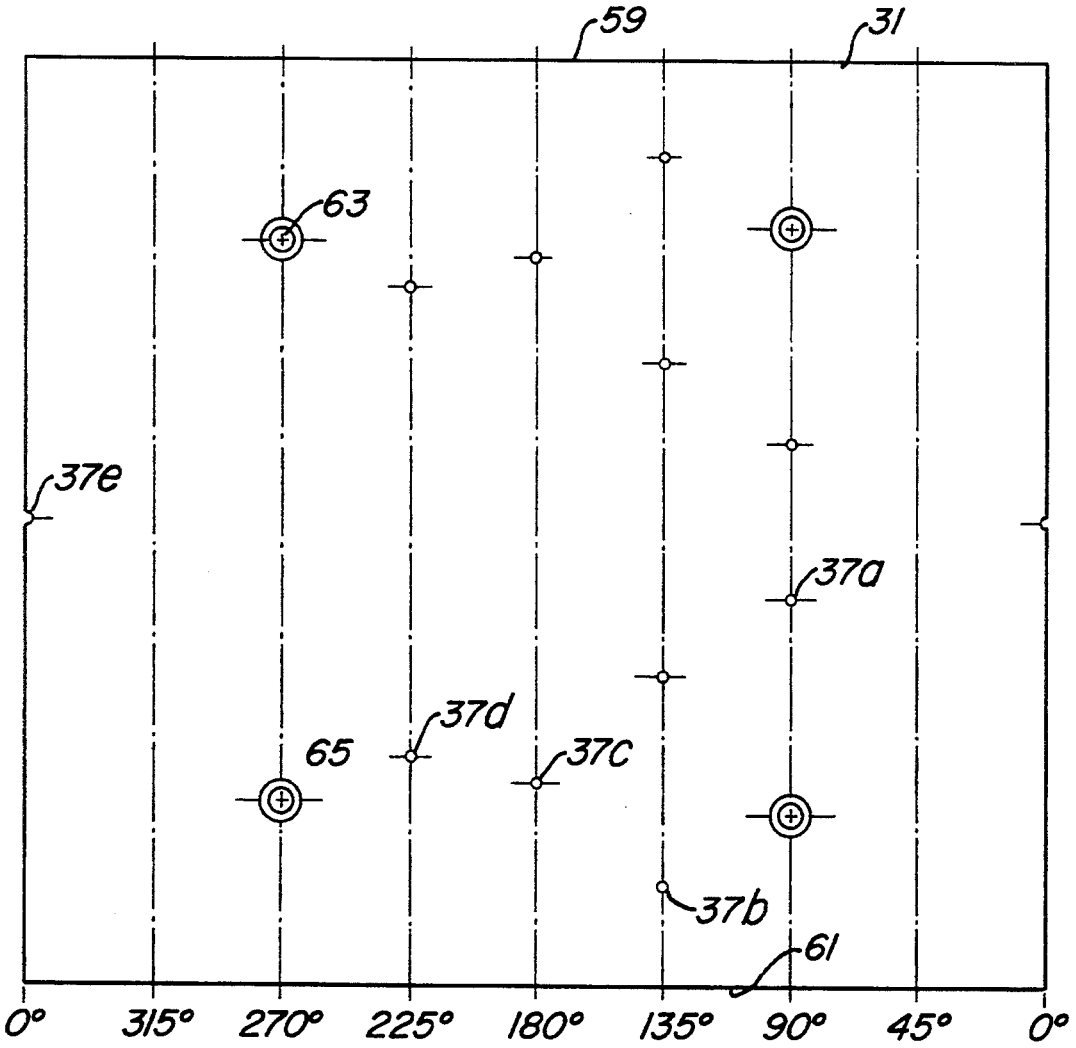
FIG. 4 is a schematic view of the cylinder of FIG. 3, but laid out flat to illustrate the positions of the various ports.

Referring to FIG. 3, angular lines are shown to illustrate preferred angular locations of the ports 37 (FIGS. 2A, 2B). The zero degree line represents the top of cylinder 31. FIG. 4 illustrates the angular and longitudinal spacing of the ports 37 on the cylinder 31 relative to the forward end 59 and rearward end 61 of cylinder 31. In FIG. 4, cylinder 31 is shown cut along the zero degree line and displayed flat. In the preferred embodiment, there are no ports 37 located on the 45 degree or 315 degree lines. There are two open ports 37*a* located on the 90 degree line. Each port 37*a* is located the same distance from one of the ends 59, 61. There are four ports 37*b* located on the 135 degree line. One of the ports 37*b* is located the same distance from forward end 59 as one of the ports 37*b* to rearward end 61. Similarly, another of the ports 37*b* is located the same distance from the forward end 59 as one of the ports 37*b* to the rearward end 61. There are two ports 37*c*, each located the same distance from one of the ends 59, 61 as the other. Ports 37*c* are located on the 180 degree line. There are two ports 37*d*, one of them located the same distance to forward end 59 as the other is to rearward end 61. Ports 37*d* are located on the 225 degree line. There is one port 37*e* on the zero degree line, this port being halfway between forward end 59 and rearward end 61.

There are also two delay or forward pressure relief valves 63, spaced close to the forward end 59. Similarly, there are two rearward pressure relief valves 65 spaced close to the rearward end 61. In the embodiment shown, the forward valves 63 are located on the 90 degree and 270 degree lines. The rearward valves 65 are located also on the 90 degree and 270 degree valves. The forward valves 63 are located the same distance from forward end 59 as the rearward valves 65 are from rearward end 61. Forward valves 63 are spaced closer to forward end 59 than all of the ports 37 except one of the ports 37*b*. Similarly, rearward valves 65 are spaced closer to rearward end 61 than all of the ports 37 except for one of the ports 37*b*.

Figure 5:
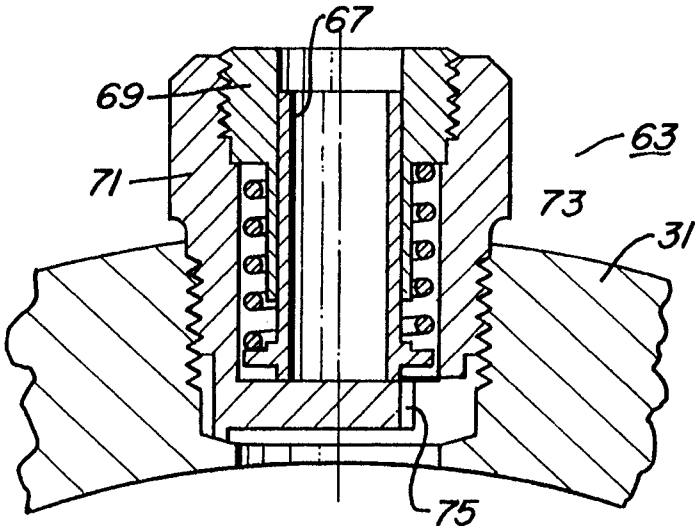
FIG. 5 is a sectional view of a pressure relief valve that is employed in some of the ports shown in FIG. 4.

FIG. 5 illustrates the structure of a suitable pressure relief valve 63, with the valve 65 being identical. Valve 63 is of a type that will allow the outflow of fluid from cylinder 31 when the pressure in the inner chamber 33 exceeds that of outer chamber 35 by a selected amount. In the embodiment shown, it will not allow any flow back inward from outer chamber 35 to inner chamber 33. Valve 63 includes a reciprocal closure member 67 that is slidingly carried within a retainer 69. Closure member 67 is tubular, open at the lower and upper end as is retainer 69. Retainer 69 screws into a valve housing 71 that screws into an orifice in cylinder 31. A spring 73 urges closure member 67 downward to seal against the base of valve housing 71. Ports 75 extend through valve housing 71 to the exterior of closure member 67. An increase in pressure will tend to push closure member 67 upward, compressing spring 73 and allowing outflow of fluid.

Figure 6:
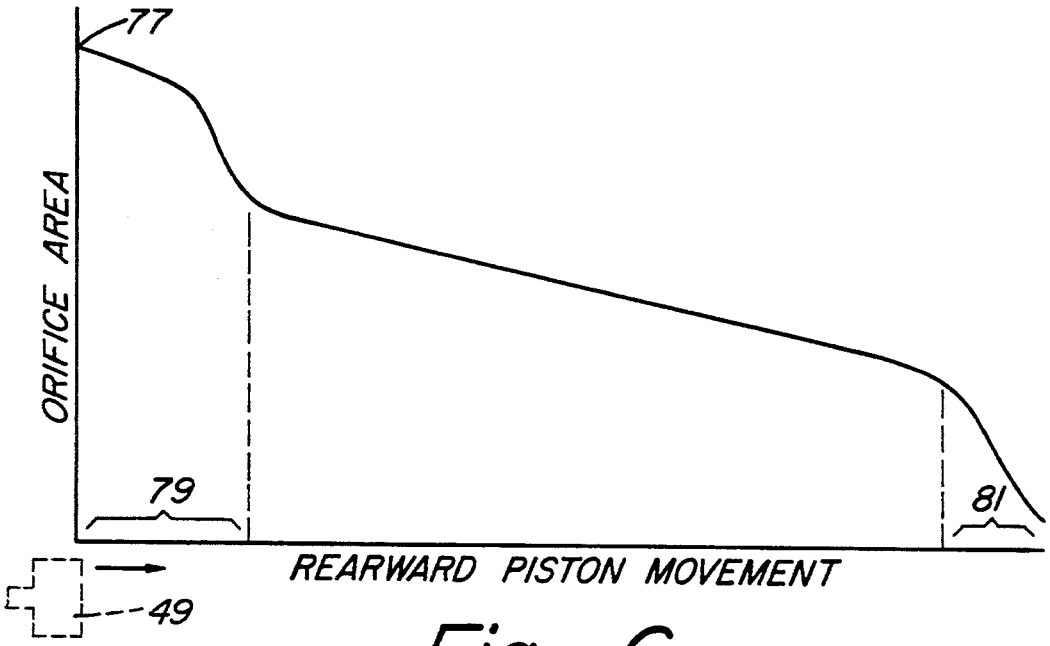
FIG. 6 is a graph illustrating the total outflow orifice area that is forward of the rearward piston of the shock absorber in FIGS. 2A and 2B as the rearward piston moves forward relative to the cylinder.

FIG. 6 illustrates the outflow orifice area that will be located forward of rearward piston 49 as piston 49 moves forward relative to cylinder 31. This movement occurs when frame 11 slides forward relative to center sill 13 (FIG. 1). Rearward piston 49 does not move relative to frame 11 because of contact of its stop end 57 with rearward stationary stop 21 (FIG. 1). Cylinder 31 is stationary with center sill 13. The left hand side of the diagram of FIG. 6 illustrates rearward piston 49 in its fully extended position.

In this position, all of the ports 37 shown in FIG. 4 and the pressure relief valves 63 and 65 are located forward of the face of piston 49. The ports 37 have identical flow areas in the preferred embodiment, and the sum of the flow areas of the ports 37 forward of piston 49 when piston 49 is fully extended is illustrated by point 77. As piston 49 moves forward relative to cylinder 31, as indicated by the arrow in FIG. 6, piston 49 will pass some of the ports 37 as well as passing the relief valve 65. Consequently, there will be fewer ports 37 on the forward side of piston 49 for the flow of liquid out into outer chamber 35 (FIG. 2B) as piston 49 moves forward.

The sum of the flow areas decreases as illustrated by the graph of FIG. 6 until rearward piston 49 is fairly close to touching forward piston 47. At this point, the face of rearward piston 49 will have passed all of the ports 37 and the forward pressure relief valves 63, except the port 37*b* closest to the forward end 59 (FIG. 4). The frame 11 will contact a stop before rearward piston 49 touches forward piston 47, which remains in its extended position during the shock absorbing movement described. The outflow orifice area decreases essentially to zero when rearward piston 49 is fully retracted. The curve or graph of FIG. 6 is idealized, and actually will show a decrease in incremental steps.

There is a rearward zone 79 that contains the two rearward pressure relief valves 65 and one of the ports 37*b*. Rearward zone 79 extends forward from the face of piston 49 when piston 49 is located in contact with rearward bulkhead 41. When piston 49 starts to move forward relative to cylinder 31 (FIG. 2B), the orifice area of rearward zone 79 does not allow any significant outflow. The closest port 37*b* is passed by piston 49 within about one-fourth inch of movement of piston 49 when piston 49 begins to move from the extended position, therefore pushing little liquid out. The spring 73 requires a certain amount of time to open the closure member 67 (FIG. 5), such as 10 to 15 milliseconds, even with a strong shock. The shock moves the rearward piston 49 too fast for the rearward pressure relief valves 65 to open. As a result, the outflow orifice area in rearward zone 79 does not exist as illustrated in the graph when rearward piston 49 starts to move forward relative to cylinder 31 from the extended position due to a shock.

There is a forward zone 81 which contains forward relief valves 63 and one of the ports 37b. Forward zone 81 extends immediately rearward of the face of forward piston 47 (FIG. 2A). There is plenty of time for the forward relief valves 63 to open when rearward piston 49 begins to move forward relative to cylinder 31. Consequently, this outflow area is actually in existence.

Figure 7:
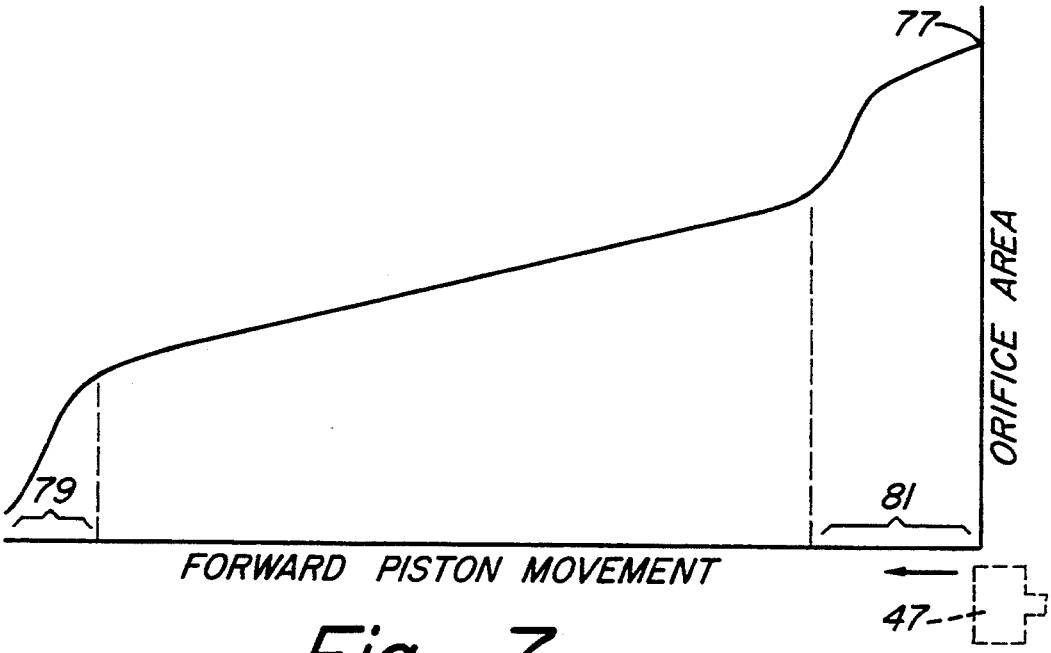
FIG. 7 is a graph illustrating the total outflow orifice area that is rearward of the forward piston of the shock absorber in FIGS. 2A and 2B when the forward piston moves rearward relative to the cylinder.

Ports 37 and relief valves 63, 65 are symmetrical relative to the ends 59, 61 of cylinder 31. The outflow orifice area as measured from the rearward end for rearward piston 49, shown in FIG. 6, is the same as if measured for forward piston 47 when forward piston 47 moves rearward relative to cylinder 31, as shown in FIG. 7. In this instance, forward zone 81, which contains the forward relief valves 63 and one port 37*b*, is not part of the flow area because port 37*b* is so close to piston 47 when piston 47 is in the extended position. Forward valves 63 will not have enough time to open when forward piston 47 moves rearward relative to cylinder 31 from the extended position due to a shock. The flow area gradually decreases as forward piston 47 moves rearward relative to cylinder 31. Rearward pressure relief valves in rearward zone 79 have plenty of time to open, and thus do present a flow area for outflow as forward piston 47 moves rearward relative to cylinder 31. The outflow areas for both the rearward and forward movement of pistons 47, 49 is thus symmetrical.

In operation, under a static condition, the pistons 47, 49 (FIGS. 2A, 2B) will be in an extended position shown due to internal gas pressure in chambers 33 and 35, which is sufficient to provide approximately 5000 pounds force to move one of the pistons 47, 49 to an extended position. As shown in FIG. 1, the shafts 51, 55 will be fully extended, and substantially touching the stationary stops 19, 21. Then, if a shock occurs, which causes the frame 11 to slide forward relative to center sill 13, rearward stationary stop 21 will slide with it. Rearward piston 49 (FIG. 2B) and rearward shaft 55 will move forward with stationary stop 21, while housing 25 and cylinder 31 remain stationary with center sill 13. Forward stationary stop 19 moves forward from forward shaft 51. This occurs because forward piston 47 will remain in abutment with forward bulkhead 39 (FIG. 2A) and thus will remain stationary with housing 25.

Rearward piston 49 (FIG. 2B) forces liquid out the various ports 37, dampening the forward movement of frame 11 relative to center sill 13. During the initial forward movement of piston 49 relative to cylinder 31, return flow of fluid into inner chamber 33 is through the return flow passages 48 in rearward bulkhead 41 to bulkhead recess 46. As piston 49 passes some of the ports 37 (FIG. 4), fluid in the outer chamber 35 (FIG. 2B) will also flow back in rearward of rearward piston 49 through those ports 37 to handle the displacement. During the initial shock, the pressure relief valves 65 in rearward zone 79 will not open, but the pressure relief valves 63 in forward zone 81 will open. Depending upon the extent of the shock, rearward piston 49 may retract until almost in contact with forward piston 47 (FIG. 2A).

Once the shock has been dissipated or absorbed, there may be another shock that tends to move frame 11 (FIG. 1) back rearward to a neutral position relative to center sill 13. Or, otherwise, internal gas pressure in cylinder 31 (FIG. 2B) will push rearward piston 49 rearward relative to cylinder 31, causing frame 11 to move back to a neutral position. This extending movement results in piston 49 eventually contacting rearward bulkhead 41.

A shock that moves frame 11 rearward relative to center sill 13 acts in reverse to the sequence described above. Forward shaft 51 bears against forward stop 19, and thus moves rearward relative to housing 25 and cylinder 31 (FIG. 2A), moving forward piston 47 rearward relative to cylinder 31. Rearward stationary stop 21 will move away from rearward shaft 55. Rearward piston 49 remains in the extended position. The fluid in inner chamber 33 is forced out ports 37, dampening the shock in the same manner as previously described. The forward pressure relief valves 63 will not open at the onset of the shock, and forward piston 47 moves rearward of forward valves 63 before they have an opportunity to open. The rearward valves 65, however, will open to provide flow areas for the flow of fluid from inner chamber 33 rearward of forward piston 47. Return flow into chamber 33 occurs through passages 48 in forward bulkhead 39 to bulkhead recess 46, and through the other ports 37 as the forward piston 47 moves past them.

The invention has significant advantages. By utilizing internal gas as a spring, a large coil spring is not needed. This reduces the weight and complexity of the system. The shock absorber is easily installable on prior art type rail cars which have sliding center sills, but which previously utilized a single shaft and a coil spring to return. The spring delay valves provide an approximately uniform rate of deceleration.

While the invention has been shown in only one of its forms, it should be apparent to those skilled in the art that it is not so limited, but is susceptible to various changes without departing from the scope of the invention.

I claim:

1. In a rail car having a frame, a center sill carried by the frame for longitudinal sliding movement relative to the frame and having coupling ends protruding from each end of the frame for connecting to adjacent rail cars, a pair of stationary stops mounted stationarily to the frame and longitudinally spaced apart from each other, an improved shock absorber for absorbing shock as the frame moves relative to the center sill, comprising in combination:

a cylinder mounted stationarily to the center sill, having opposite ends, each end having a bore;

a pair of pistons, slidably carried in the cylinder for independent movement relative to each other;

a pair of shafts, each connected to one of the pistons, the shafts extending slidingly in opposite directions through the bores provided at the ends of the cylinder between retracted and extended positions, each of the shafts terminating in a stop end for engaging one of the stationary stops;

a fluid of liquid and gas contained in the cylinder for dampening movement of the pistons relative to the cylinder;

return flow means for allowing fluid that is located between the pistons to return behind each of the pistons as each of the pistons moves relative to the cylinder when the center sill and the frame move relative to each other; and the distance from one stop end to the other stop end when both of the shafts are fully extended being no greater than the distance between the stationary stops, so that the shock absorber may be installed between the stationary stops without moving either of the shafts inward from the extended position.

2. In a rail car having a frame, a center sill carried by the frame for longitudinal sliding movement relative to the frame and having coupling ends protruding from each end of the frame for connecting to adjacent rail cars, a pair of stationary stops mounted stationarily to the frame and longitudinally spaced apart from each other, an improved shock absorber for absorbing shock as the frame moves relative to the center sill, comprising in combination:

a housing stationarily mounted to the center sill;

a cylinder having opposite ends and located within the housing, defining an inner chamber within the cylinder and an outer chamber within the housing and at least partially surrounding the cylinder;

a pair of pistons, slidably carried in the cylinder for independent movement relative to each other;

a pair of shafts, each connected to one of the pistons, the shafts extending slidingly in opposite directions through bores provided at the ends of the cylinder between retracted and extended positions, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of the pistons relative to the cylinder when the center sill and the frame move relative to each other; and the distance from one stop end to the other stop end when both of the shafts are fully extended being no greater than the distance between the stationary stops, so that the shock absorber may be installed between the stationary stops without moving either of the shafts inward from the extended position.

3. The shock absorber according to claim 2, wherein the ports are in locations that are symmetrical relative to each end of the cylinder.

4. The shock absorber according to claim 2, wherein:

each of the ports has a flow area; and the sum of the flow areas of the ports measured at incremental distances from one end of the cylinder decreases at a selected rate; and the sum of the flow areas of the ports measured at incremental distances from the opposite end of the cylinder decreases at the same selected rate.

5. In a rail car having a frame, a center sill carried by the frame for longitudinal sliding movement relative to the frame and having coupling ends protruding from each end of the frame for connecting to adjacent rail cars, a pair of stationary stops mounted stationarily to the frame and longitudinally spaced apart from each other, an improved shock absorber for absorbing shock as the frame moves relative to the center sill, comprising in combination:

a housing stationarily mounted to the center sill;

a cylinder having opposite ends and located within the housing, defining an inner chamber within the cylinder and an outer chamber within the housing and at least partially surrounding the cylinder;

a pair of pistons, slidably carried in the cylinder for independent movement relative to each other;

a pair of shafts, each connected to one of the pistons, the shafts extending slidingly in opposite directions through bores provided at the ends of the cylinder, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of the pistons relative to the cylinder when the center sill and the frame move relative to each other; and wherein:

the ports are positioned at selected distances from each end of the cylinder;

and wherein the shock absorber further comprises:

a delay valve located in at least one of the ports that is close to one end of the cylinder and another delay valve located in at least another of the ports that is close to the opposite end of the cylinder, the delay valves preventing for a selected time duration flow of the fluid through the delay valves from the inner chamber to the outer chamber when the pressure in the inner chamber is greater than the pressure in the outer chamber, the time duration being selected such that when one of the pistons begins to move from an extended position to a retracted position due to a shock, the delay valve nearest said one of the pistons will not open but the delay valve opposite said one of the pistons will open.

6. In a rail car having a frame, a center sill carried by the frame for longitudinal sliding movement relative to the frame and having coupling ends protruding from each end of the frame for connecting to adjacent rail cars, a pair of stationary stops mounted stationarily to the frame and longitudinally spaced apart from each other, an improved shock absorber for absorbing shock as the frame moves relative to the center sill, comprising in combination:

a housing stationarily mounted to the center sill;

a cylinder having opposite ends and located within the housing, defining an inner chamber within the cylinder and an outer chamber within the housing and at least partially surrounding the cylinder;

a pair of pistons, slidably carried in the cylinder for independent movement relative to each other;

a pair of shafts, each connected to one of the pistons, the shafts extending slidingly in opposite directions through bores provided at the ends of the cylinder, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of the pistons relative to the cylinder when the center sill and the frame move relative to each other; and wherein:

each of the pistons has a retracted and an extended position;

the ports are positioned at selected distances from each end of the cylinder;

and wherein the shock absorber further comprises:

means for restricting flow through at least one of the ports close to one of the pistons when said one of the pistons begins to move from the extended position toward the retracted position due to a shock, but for allowing free flow through said one of the ports when the other of the pistons begins to move from the extended position toward the retracted position due to a shock.

7. In a rail car having a frame, a center sill carried by the frame for longitudinal sliding movement relative to the frame and having coupling ends protruding from each end of the frame for connecting to adjacent rail cars, a pair of stationary stops mounted stationarily to the frame and longitudinally spaced apart from each other, an improved shock absorber for absorbing shock as the frame moves relative to the center sill, comprising in combination:

a housing stationarily mounted to the center sill;

a cylinder having opposite ends and located within the housing, defining an inner chamber within the cylinder and an outer chamber within the housing and at least partially surrounding the cylinder;

a pair of pistons, slidably carried in the cylinder for independent movement relative to each other;

a pair of shafts, each connected to one of the pistons, the shafts extending slidingly in opposite directions through bores provided at the ends of the cylinder, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of the pistons relative to the cylinder when the center sill and the frame move relative to each other; and wherein:

the ports are positioned at selected distances from each end of the cylinder, and are in locations and have flow areas that are symmetrical relative to each end of the cylinder;

and wherein the shock absorber further comprises:

a delay valve located in at least one of the ports that is close to one end of the cylinder and another delay valve located in at least another of the ports that is close to the opposite end of the cylinder, the delay valves preventing for a selected time duration flow of the fluid through the delay valves from the inner chamber to the outer chamber when the pressure in the inner chamber is greater than the pressure in the outer chamber, the time duration being selected such that when one of the pistons begins to move from an extended position to a retracted position due to a shock, the delay valve nearest said one of the pistons will not open but the delay valve opposite said one of the pistons does open.

8. In a rail car having a frame, a center sill carried by the frame for longitudinal sliding movement relative to the frame and having coupling ends protruding from each end of the frame for connecting to adjacent rail cars, a pair of stationary stops mounted stationarily to the frame and longitudinally spaced apart from each other, an improved shock absorber for absorbing shock as the frame moves relative to the center sill, comprising in combination:

a housing stationarily mounted to the center sill;

a cylinder having opposite ends and located within the housing, defining an inner chamber within the cylinder and an outer chamber within the housing and at least partially surrounding the cylinder;

a pair of pistons, slidably carried in the cylinder for independent movement relative to each other;

a pair of shafts, each connected to one of the pistons, the shafts extending slidingly in opposite directions through bores provided at the ends of the cylinder, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of the pistons relative to the cylinder when the center sill and the frame move relative to each other; and wherein:

each of the pistons has a retracted and an extended position;

the ports are positioned at selected distances from each end of the cylinder and are in locations and have flow areas that are symmetrical relative to each end of the cylinder;

and wherein the shock absorber further comprises:

means for restricting flow through at least one of the ports close to one of the pistons when said one of the pistons begins to move from the extended position toward the retracted position due to a shock, but for allowing free flow through said one of the ports when the other of the pistons begins to move from the extended position toward the retracted position due to a shock.

9. In a rail car having a frame, a center sill carried by the frame for longitudinal sliding movement relative to the frame and having coupling ends protruding from each end of the frame for connecting to adjacent rail cars, a pair of stationary stops mounted stationarily to the frame, an improved shock absorber for absorbing shock as the center sill and the frame move relative to each other, comprising in combination:

a housing mounted stationarily to the center sill;

a cylinder located stationarily within the housing, defining an inner chamber within the cylinder and an outer chamber within the cylinder and at least partially surrounding the cylinder;

forward and rearward bulkheads located at opposite ends of the cylinder, each of the bulkheads having a bore;

forward and rearward pistons, each slidably carried in the cylinder for independent movement relative to each other between an extended position in contact with one of the bulkheads and a retracted position spaced longitudinally from each of the bulkheads;

forward and rearward shafts, connected respectively to the forward and rearward pistons, the shafts extending in opposite directions slidingly through the bores in the forward and rearward bulkheads, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of one of the pistons and the cylinder relative each other;

each of the ports having a flow area;

the sum of the flow areas of the ports measured at incremental distances from the forward bulkhead toward the rearward bulkhead decreasing at a selected rate;

the sum of the flow areas of the ports measured at incremental distances from the rearward bulkhead toward the forward bulkhead decreasing at the same selected rate; and the distance from one stop end to the other stop end when both of the shafts are fully extended being no greater than the distance between the stationary stops, so that the shock absorber may be installed between the stationary stops without moving either of the shafts inward from the extended position.

10. In a rail car having a frame, a center sill carried by the frame for longitudinal sliding movement relative to the frame and having coupling ends protruding from each end of the frame for connecting to adjacent rail cars, a pair of stationary stops mounted stationarily to the frame, an improved shock absorber for absorbing shock as the center sill and the frame move relative to each other, comprising in combination:

a housing mounted stationarily to the center sill;

a cylinder located stationarily within the housing, defining an inner chamber within the cylinder and an outer chamber within the cylinder and at least partially surrounding the cylinder;

forward and rearward bulkheads located at opposite ends of the cylinder, each of the bulkheads having a bore;

forward and rearward pistons, each slidably carried in the cylinder for independent movement relative to each other between an extended position in contact with one of the bulkheads and a retracted position spaced longitudinally from each of the bulkheads;

forward and rearward shafts, connected respectively to the forward and rearward pistons, the shafts extending in opposite directions slidingly through the bores in the forward and rearward bulkheads, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of one of the pistons and the cylinder relative each other;

each of the ports having a flow area;

the sum of the flow areas of the ports measured at incremental distances from the forward bulkhead toward the rearward bulkhead decreasing at a selected rate;

the sum of the flow areas of the ports measured at incremental distances from the rearward bulkhead toward the forward bulkhead decreasing at the same selected rate;

a rearward valve means located in at least one of the ports that is close to the rearward bulkhead for restricting flow through the rearward valve means from the inner chamber if the rearward piston begins to move forward relative to the cylinder from the extended position due to a shock, and for allowing free flow through the rearward valve means from the inner chamber if the forward piston begins to move rearward relative to the cylinder from the extended position due to a shock; and a forward valve means located in at least one of the ports that is close to the forward bulkhead for restricting flow through the forward valve means from the inner chamber if the forward piston begins to move rearward relative to the cylinder from the extended position due to a shock, and for allowing free flow through the forward valve means from the inner chamber if the rearward piston begins to move forward relative to the cylinder from the extended position due to a shock.

11. In a rail car having a frame, a center sill carried by the frame for longitudinal sliding movement relative to the frame and having coupling ends protruding from each end of the frame for connecting to adjacent rail cars, a pair of stationary stops mounted stationarily to the frame, an improved shock absorber for absorbing shock as the center sill and the frame move relative to each other, comprising in combination:

a housing mounted stationarily to the center sill;

a cylinder located stationarily within the housing, defining an inner chamber within the cylinder and an outer chamber within the cylinder and at least partially surrounding the cylinder;

forward and rearward bulkheads located at opposite ends of the cylinder, each of the bulkheads having a bore;

forward and rearward pistons, each slidably carried in the cylinder for independent movement relative to each other between an extended position in contact with one of the bulkheads and a retracted position spaced longitudinally from each of the bulkheads;

forward and rearward shafts, connected respectively to the forward and rearward pistons, the shafts extending in opposite directions slidingly through the bores in the forward and rearward bulkheads, each of the shafts terminating in a stop end for engaging one of the stationary stops;

a fluid of liquid and gas contained in the inner and outer chambers;

a plurality of ports in the cylinder between the inner and outer chambers to allow flow of the fluid between the inner and outer chambers due to movement of one of the pistons and the cylinder relative each other;

each of the ports having a flow area;

the sum of the flow areas of the ports measured at incremental distances from the forward bulkhead toward the rearward bulkhead decreasing at a selected rate;

the sum of the flow areas of the ports measured at incremental distances from the rearward bulkhead toward the forward bulkhead decreasing at the same selected rate;

a spring biased rearward valve located in at least one of the ports that is close to the rearward bulkhead, which allows flow from the inner chamber when pressure in the inner chamber exceeds the pressure in the outer chamber sufficiently to overcome a spring force of the rearward valve, the rearward valve being sized and located so that forward movement of the rearward piston relative to the cylinder from the extended position due to a shock on the rail car will not open the rearward valve, but rearward movement of the forward piston relative to the cylinder from the extended position due to a shock on the rail car will open the rearward valve; and a spring biased forward valve located in at least one of the ports that is close to the forward bulkhead, which allows flow from the inner chamber when pressure in the inner chamber exceeds the pressure in the outer chamber sufficiently to overcome a spring force of the forward valve, the forward valve being sized and located so that rearward movement of the forward piston relative to the cylinder from the extended position due to a shock on the rail car will not open the forward valve, but forward movement of the rearward piston relative to the cylinder from the extended position due to a shock on the rail car will open the forward valve.

12. A method for absorbing shock in a rail car having a frame, a center sill carried by the frame for longitudinal sliding movement relative to the frame and having coupling ends protruding from each end of the frame for connecting to adjacent rail cars, and forward and rearward stationary stops mounted to the frame at longitudinally spaced apart locations, the method comprising:

providing a cylinder;

mounting forward and rearward bulkheads at each end of the cylinder, and providing each of the bulkheads with a bore;

placing forward and rearward pistons in the cylinder, and providing the forward and rearward pistons with forward and rearward shafts, respectively, that extend slidingly through the bores in the forward and rearward bulkheads, respectively;

placing a fluid of liquid and gas in the cylinder and providing sufficient pressure of the gas in the fluid to move the forward and rearward pistons apart from each other to extended positions in engagement with the forward and rearward bulkheads, respectively;

while maintaining the pistons are in the extended positions, placing the cylinder between stationary stops mounted to the frame of the rail car and securing the cylinder stationarily to the center sill;

when the frame moves forward relative to the center sill due to a shock, contacting the rearward shaft with the rearward stationary stop, causing the rearward piston to move forward relative to the cylinder from the extended position and moving the forward stationary stop away from the forward shaft;

as the rearward piston moves forward relative to the cylinder, pushing fluid in the cylinder that is forward of the rearward piston back into the cylinder rearward of the rearward piston, dampening shock;

when the frame moves rearward relative to the center sill due to a shock, contacting the forward shaft with the forward stationary stop, causing the forward piston to move rearward relative to the cylinder and moving the rearward stationary stop away from the rearward shaft; and as the forward piston moves rearward relative to the cylinder, pushing fluid rearward of the forward piston back into the cylinder forward of the forward piston, dampening shock.

* * * * *